US005394943A

United States Patent [19]

Harrington

[11] Patent Number: 5,394,943

[45] Date of Patent: Mar. 7, 1995

[54] SUBSURFACE SHUTDOWN SAFETY VALVE AND ARRANGEMENT SYSTEM

[76] Inventor: Donald R. Harrington, 102 Kilbourne Cir., Carencro, La. 70520

[21] Appl. No.: 148,836

[22] Filed: Nov. 5, 1993

[51] Int. Cl.[6] ..... E21B 34/06

[52] U.S. Cl. ..... 166/373; 166/91; 166/95; 166/382; 166/386; 403/59

[58] Field of Search ..... 166/90, 91, 95, 72, 166/216, 243, 373, 382, 386; 405/53, 59

[56] References Cited

U.S. PATENT DOCUMENTS

| | | | |
|---|---|---|---|
| Re. 25,109 | 1/1962 | Natho | 166/72 |
| 1,921,358 | 8/1933 | Hill et al. | 405/59 X |
| 2,546,638 | 3/1951 | Humason | 166/95 X |
| 2,704,579 | 3/1955 | Brown | 166/382 X |
| 2,785,755 | 3/1957 | En Dean | 166/72 |
| 2,796,133 | 6/1957 | En Dean | 166/73 |
| 2,831,539 | 4/1958 | En Dean et al. | 166/73 |
| 2,901,889 | 9/1959 | Reed | 405/53 |
| 3,078,923 | 2/1963 | Tausch . | |
| 3,105,358 | 10/1963 | Reed . | |
| 3,457,991 | 7/1969 | Sizer et al. | 166/72 |
| 3,459,260 | 4/1969 | Dollison | 166/73 |
| 3,490,240 | 10/1970 | Preston | 405/59 X |
| 3,491,831 | 1/1970 | Dollison | 166/72 |
| 3,505,821 | 4/1970 | Scisson et al. | 405/53 |
| 3,530,674 | 9/1970 | Cobbs et al. . | |
| 3,738,426 | 6/1973 | Drouin | 166/382 |
| 4,082,147 | 4/1978 | Wolff et al. | 166/375 |
| 4,650,226 | 3/1987 | Babbitt et al. | 285/348 |
| 4,842,074 | 6/1989 | Hines et al. | 405/53 |
| 4,991,624 | 2/1991 | Fowler et al. | 405/59 X |
| 5,103900 | 4/1992 | McLeod et al. | 166/88 |
| 5,203,409 | 4/1993 | Seid et al. | 166/88 X |
| 5,289,882 | 3/1994 | Moore | 166/65.1 X |

*Primary Examiner*—Roger J. Schoeppel
*Attorney, Agent, or Firm*—William W. Stagg

[57] ABSTRACT

A subsurface shutdown safety valve spool piece for installation on underground salt dome cavern storage wells having a cased wellhead at ground level for product input and removal, a cased wellbore and a tubing string extending to the cavern storage area which forms an annular space between the wellbore and the tubing string for product removal. The spool piece includes a tubular casing for mounting between the wellhead casing and the cased borehole, a hanger for suspending the tubing string, seals for sealing the annular space, piping communicating with the annular space above and below the annular space seals and a remotely operated piping valve.

14 Claims, 4 Drawing Sheets

SUBSURFACE SHUTDOWN SAFETY VALVE AND ARRANGEMENT SYSTEM

FIELD OF INVENTION

This invention relates to the subsurface control of stored gas or other products in underground salt dome cavern storage wells. More particularly, it is concerned with an apparatus and method for subsurface arrangement and control of piping and valves to prevent the venting of the stored gas or product into the atmosphere during a catastrophic occurrence.

BACKGROUND OF THE INVENTION

In the oil and gas industry, and in other related industries, salt dome caverns within the earth are utilized for storing liquid or gaseous materials such as oil, natural gas, butane, hazardous waste and the like. These salt dome caverns are accessed first by drilling a well from the surface into the salt dome, lining the drilled well borehole with casing, and then removing the undesired salt from the salt dome with fresh water to create the desired storage area. Many different techniques are used to remove the salt and create the storage area, the most common of which is fresh water etching or in situ salt mining.

After the cavern has been etched to the desired storage capacity, the well may be utilized for product storage. It is present industry practice to place tubing down into the cavern storage area through the cased borehole. The tubing is suspended in the cased borehole by a casing hanger. A wellhead casing with inlet and outlet flanges, fitted with appropriate valves, are connected to both the tubing and borehole casing. The tubing and the cased borehole serve dual purposes as both may be used as a conduit to and from the cavern storage area for placing and for removing the stored product through their respective inlet and outlet flanges.

Once created the cavern storage area typically contains brine water which is a by product of the cavern formation process. In storing product the brine water is displaced by the product as it is injected into the cavern. In removal of product, brine water is injected for displacing the stored product out of the cavern storage area.

To store a gas product such as butane gas in the cavern, it is current practice to place the gas into the underground cavern storage area by injecting the gas into the cased borehole through the wellhead casing inlet and casing flange down into the cavern. This gas displaces the stored brine water and effectuates its flow upward through the tubing to the surface through the tubing outlet flange in the wellhead for storage or disposal.

Product is removed in a similar manner, that is, by injecting brine water through the wellhead tubing inlet and tubing inlet flange down into the cavern to displace the stored gas and effectuate its flow upward to the surface for exit through the cased borehole outlet flange. The stored gas may then be transported for use. The flow of the displacing gas or brine water into and out of the storage cavern is typically controlled at the surface by a system of piping and surface control valves connected to the wellhead inlet and outlet flanges.

This current practice of only utilizing surface controls for the flow into and out of the storage well leaves the storage well and the stored product vulnerable to the atmosphere and at risk to explosion or blowout in the event of a disruption of the surface control valve system. While subsurface control valves are utilized in the oil and gas industry for control of producing wells, such valves are not utilized and are not readily adaptable for utilization on salt dome storage wells. At present, no system exists to provide a subsurface control valve that will accommodate the current techniques utilized to remove product from the storage caverns.

For instance, in production wells the annulus area (the area between the casing and the tubing) is typically sealed by a packer situated above the production zones of the well. The packer seal diverts the production flow from the annulus to the production tubing which is used to bring the production to the surface. Tubing chokes such as those illustrated in U.S. Pat. Nos. 2,785,755, 2,796,133 and 2,831,539 all to En Dean for oil well storm chokes are then utilized to shut off production in the tubing in the event of a catastrophic situation. The storm choke and packer combinations are not used to control annular flow of the product as in the case of salt cavern storage wells.

Other subsurface control valves are illustrated in U.S. Pat. No. 3,079,923 to Tausch, U.S. Pat. No. 3,457,991 to Sizer, et al and U.S. Patent Reissue No. 25,109 to Natho.

The Natho and Tausch patents teach methods for shutting off the flow in production tubing. Flow in the annulus is controlled by conventional packers as in the En Dean patents. The Sizer, et al patent teaches a production tubing control valve device where annular flow is shut off by means of conventional blowout preventers. These devices do not teach a technique for opening and closing an annular spaced utilized for product flow as in a salt dome storage facility.

Devices or means for control of pressurized storage facilities such as salt dome caverns are disclosed in U.S. Pat Nos. 3,530,674 to Cobbs, et al, 3,105,358 and 2,901,889 to Reed and 4,842,074 to Hines, et al.

The Cobbs patent discloses a method of controlling the pressure in the cavern storing anhydrous ammonia with a column of water in the annular space. The U.S. Pat. No. 3,105,358 Reed patent is directed toward sealing the annular by means of a spring biased check valve as a means to remove subsurface pumps. It does not afford a downhole shutout mechanism in the event of a catastrophe at the surface as the disclosed device requires manual removal of the surface valve bushing and repositioning of the valve flanges to shut off annular flow.

The U.S. Pat. No. 2,901,889 Reed patent teaches pressurizing the dome cavity. The U.S. Pat. No. 4,842,074 Hines, et al patent incorporates a downhole packer for directing the fluids or gas downhole by means of pressure generated at the surface level through surface control valves. Neither provides or discloses a means for subsurface shut off of product flow in the event of a catastrophic event at the surface of a storage well.

Consequently, a need exists for improvements in subsurface control of flow from underground salt dome storage wells which will allow the conventional techniques of storage and removal to be utilized but at the same time provide a means to shut off flow in the event of a surface catastrophe.

SUMMARY OF THE INVENTION

The present invention is designed to satisfy the aforementioned needs. It incorporates an annular shutdown valve arrangement below the ground surface operated from the surface by electrical or pneumatic means.

It is therefore, an object of the invention to control the release of stored hydrocarbons, hazardous waste or other products into the atmosphere through manual or automatic subsurface valve arrangement.

It is a further object of the invention to provide a subsurface valve arrangement to bypass the tubing-casing annulus having the same or substantially the same cross-sectional area as the annulus space to maintain downhole pressures and allow the desire volume of product flow.

It is a further object of the invention to arrange the valve system to route the stored product around the tubing hanger system to maintain the integrity of the hanger system in the event of a surface catastrophe.

Accordingly, the present invention relates to an apparatus and method for providing subsurface control valves in salt dome storage caverns which includes an annulus seal, a tubing hanger and an annulus seal bypass piping and valve assembly attached to the borehole casing below ground level for sealing the annulus and providing continuity of product flow around the annulus seal to the wellhead product outlet flange. The cross-sectional area of the bypass piping is substantially the same as the annulus and the valves are manually or automatically remotely controlled from the surface by pneumatic, electronic or other means.

DESCRIPTION OF THE PREFERRED EMBODIMENTS

Figure 1:
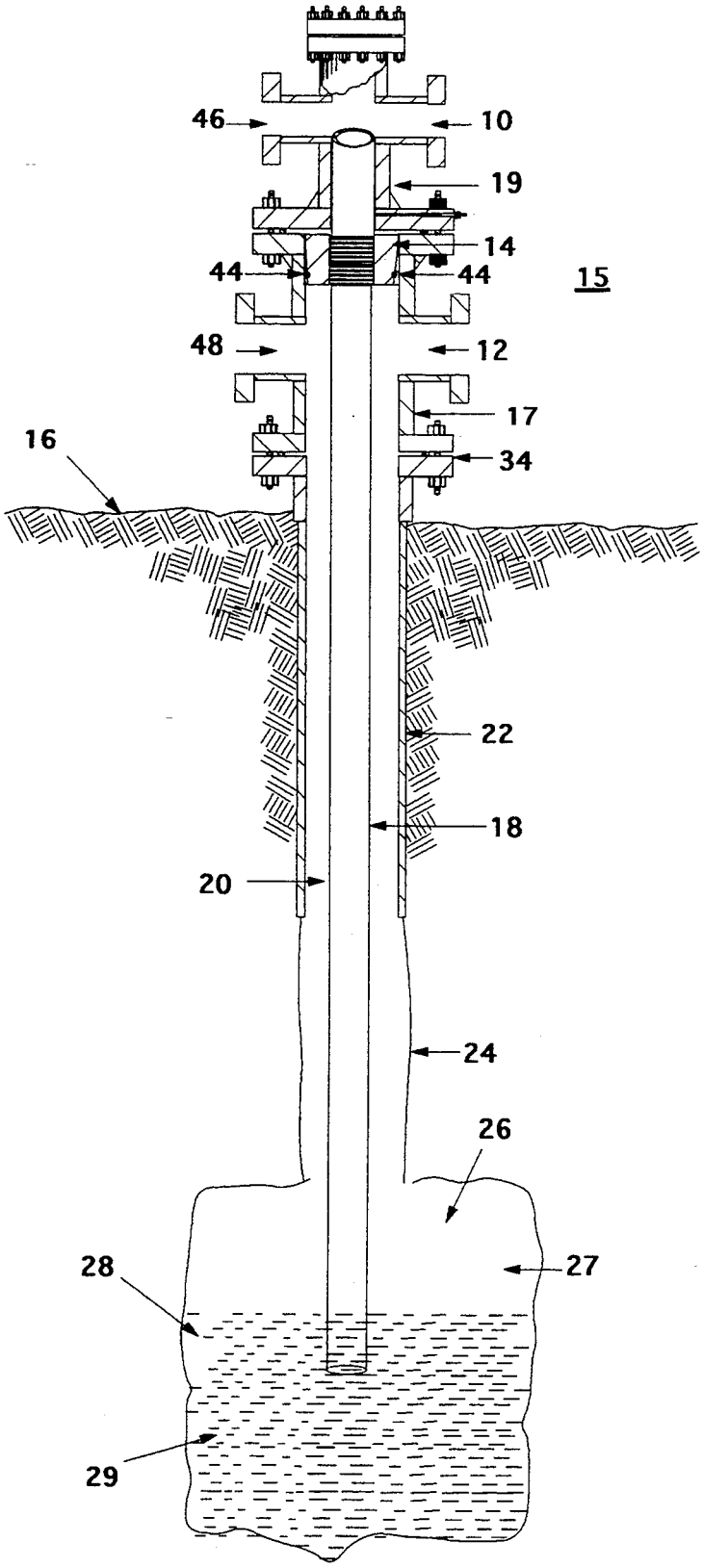
PRIOR ART FIGURE 1
FIG. 1 is a cross-sectional view of the salt dome cavern storage well typically utilized in the industry.

Referring now to the drawings, and more particularly to FIG. 1, there is shown in cross-section the salt dome storage cavern well typically utilized in the industry. The well consists of a borehole 24 drilled from the surface 16 down into the salt dome cavern storage cavity 27 which has been formed within the salt dome to a desired storage capacity. The salt dome cavity 27 is comprised of an upper cavity zone 26 and a lower cavity zone 28. The lower cavity zone 28 is typically filled with brine fluid 29. This brine fluid 29 is a by product of the process used to form the cavity 27 and serves as the driving force for displacement of the stored product.

The borehole 24 is lined from the surface to a predetermined depth with casing 22. Attached to the casing 22 by welding or other means is a Braden Head flange 34. Attached to the Braden Head flange 34 is the wellhead 15. The wellhead 15, situated above ground surface 16, is comprised of a lower casing cross flange 17 having a product inlet 12 and a product outlet 48 and an upper tubing cross flange 19 having a brine water inlet 10 and a brine water outlet 46. Though not shown for reasons of clarity, corresponding product and brine water piping, pumps and control valves are attached to the various inlets and outlets of the wellhead 15 at the surface to direct the flow of product and fluids into and out of the storage cavern.

Tubing 18 is suspended within the casing 22 down into the lower portion of the salt dome cavern cavity 28 by means of a tubing hanger 14 positioned within the casing flange 17 above inlet 12 and outlet 48. The tubing hanger 14 supports the entire weight of the tubing 22 as it reaches its full depth into the salt dome cavity 27. The tubing hanger 14 and O-rings 44 form a leak tight seal of the casing flange 17 at the tubing hanger 14 to prevent commingling of the stored product and the brine water.

Product is stored in the salt dome storage well illustrated in FIG. 1 in the following manner. Outlet 48 of casing cross flange 17 and inlet 10 of tubing cross flange 19 are closed. The product to be stored is then pumped into the wellhead 15 through cross flange 17 at inlet 12 down through the annular space 20 between the casing 22 and the tubing 18 into the upper portion of the salt dome cavity 26. The pressure of the product in the upper zone 26 of the cavity 27 displaces the brine water 29 retained in the lower zone 28 of the cavity 27 and forces it up toward the surface through the tubing 18 to the tubing cross flange 19 of the wellhead 15 where it exits the wellhead 15 through outlet 46, inlet 10 being closed at this stage of the operation.

The process of removing the stored product is the reverse of the product storing process. Inlet 12 of casing cross flange 17 and outlet 46 of tubing cross flange 19 are closed. Brine water is pumped into the wellhead 15 through inlet 10 of tubing cross flange 19 into tubing 18 and down into the lower zone 28 of the salt dome cavity 27. This forces the product stored in the cavity 27 up through the borehole 24 into the annular space 20 between the tubing 18 and the casing 20 to the wellhead 15. The product exits the wellhead 15 through outlet 48 of the casing cross flange 17, inlet 12 being closed at this stage of the operation. It can be seen that the present piping and valve arrangement affords no means to shut down product flow in the event of a untoward event at the surface.

Figure 2:
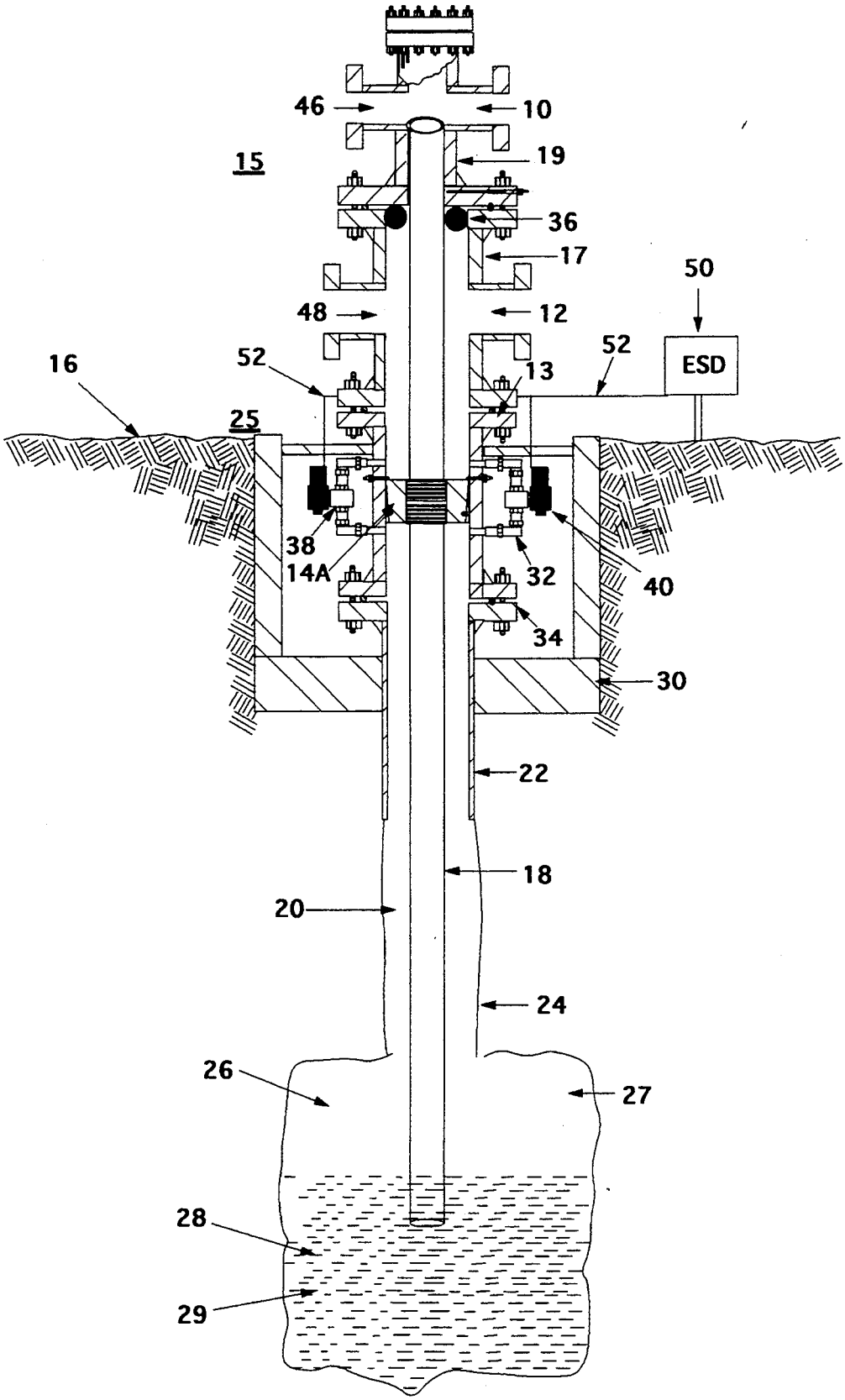
FIG. 2 is a cross-sectional view of the typical salt dome storage well with the subsurface safety shutdown invention in place.
Figure 3:
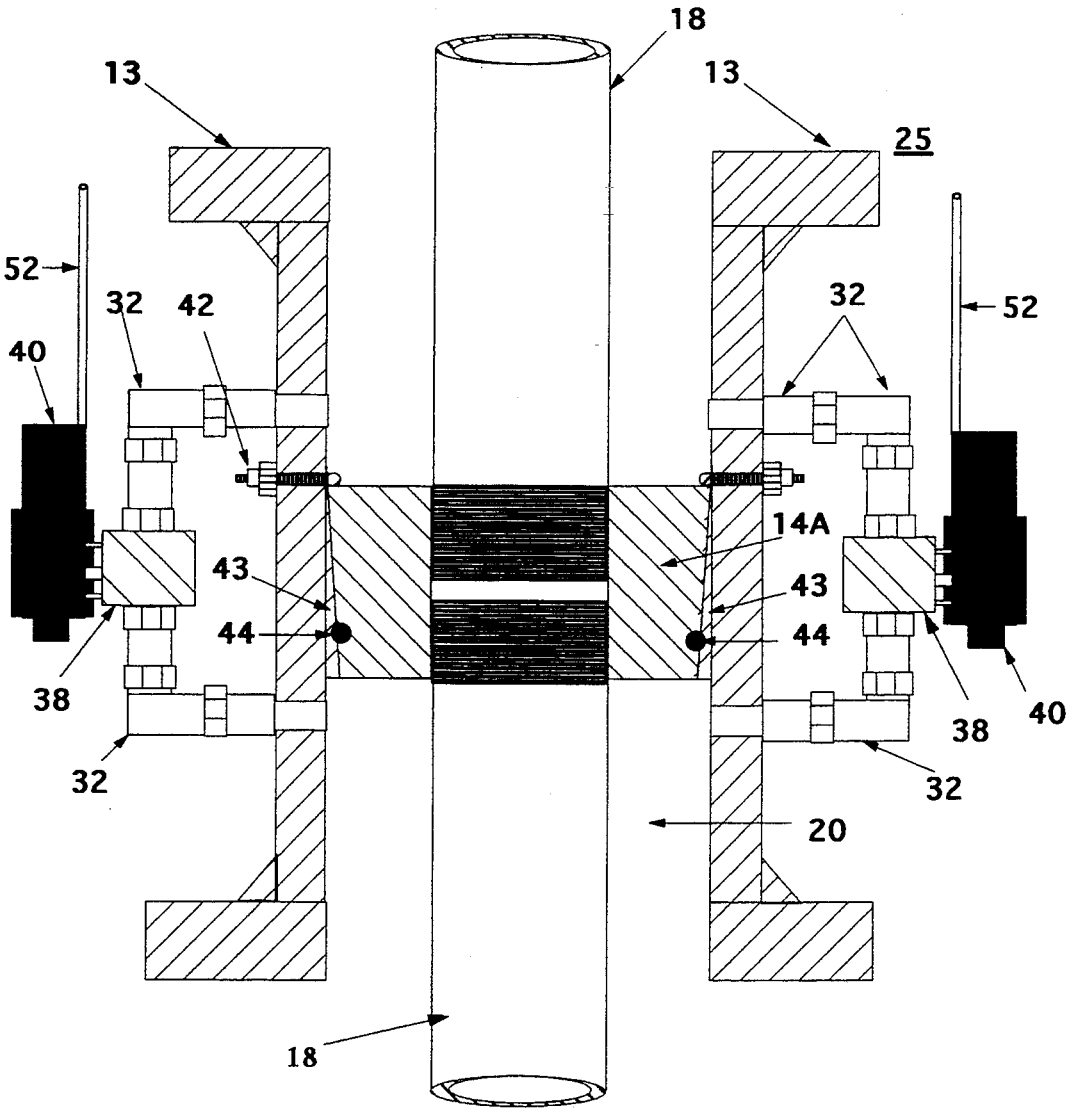
FIG. 3 is an enlarged cross-sectional view of the present invention.
Figure 4:
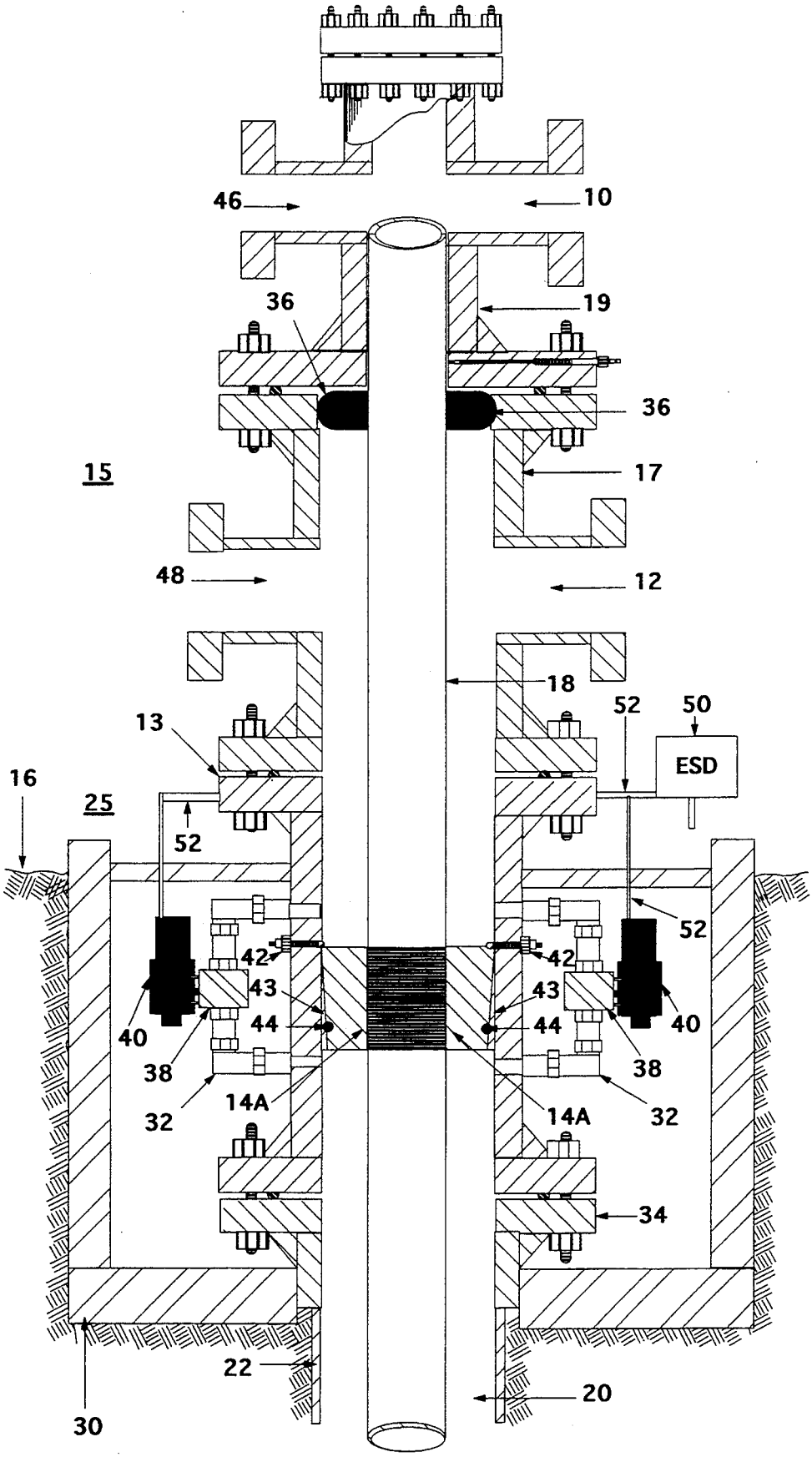
FIG. 4 is an enlarged cross-sectional view of the present invention in place below a wellhead of a storage well.

There is shown in FIG. 3 the components of the subsurface shutdown safety valve spool piece 25 which when installed in the manner described herein and shown in FIGS. 2 and 4 will provide a subsurface safety valve for use on salt dome cavern storage well installations. FIG. 2 shows the typical salt dome cavern storage well of FIG. 1 with the spool piece 25 in place. FIG. 4 is an enlarged partial cross-sectional view of FIG. 2.

The subsurface shutdown safety valve spool piece 25 of FIG. 3 is mounted to the well system below the wellhead 15 and above the Braden Head flange 34 as illustrated in FIG. 2 and 4. The Braden Head flange 34 is positioned below the ground surface 16 so that when the safety valve spool piece 25 is mounted to the Braden Head flange 34 the entire assembly may be contained within a manhole enclosure 30 so that the only upper most flange 13 of the safety valve spool piece 25 is above ground for mounting to the wellhead 15.

The safety valve spool piece 25 includes a tubing hanger 14A for suspending the tubing 18 down into the salt dome cavern cavity 27 and for providing a leak tight seal of the annular space 20 between the tubing 18 and the spool piece 25. The safety valve spool piece 25 also includes product diverter piping 32 on the outside of the spool piece 25 around the annular seal made by tubing hanger 14A.

Connected to the diverter piping 32 are valves 38 which are controlled by actuators 40 for opening and closing the valves. The diverter piping 32 and the openings of valves 38 have a total cross-sectional area the same or substantially the same as that of the annular space 20 or of the inlet 12 and outlet 48 of the casing cross flange 17 so as not to reduce product flow area. The piping 32 and valves 38 may be arranged perpendicular and parallel to the spool piece or perpendicular and diagonal to the spool piece to save space in the manhole enclosure 30.

The actuators 40 are activated from the surface by emergency shut down means or ESD 50. The ESD 50 is connected to actuators 40 by lines 52 which may be pneumatic, electrical or other means for providing remote closing of the valves 38 in the event of an emergency.

The wellhead 15 is arranged in a manner similar to that of FIG. 1 in that the casing cross flange 17 is mounted to the upper most flange 13 of the safety valve spool piece 25 and the tubing cross flange 19 is mounted above the casing cross flange 17. The tubing 18, however, is now suspended from the spool piece tubing hanger 14A, and extends into the tubing cross flange 17 at a point below the flange inlet 10 and outlet 46. A leak tight seal between the tubing 18, the tubing cross flange 19, and the casing cross flange 17 is maintained by rubber packing 36 to prevent commingling of the product and the brine water. When pressure is applied to the system the sealing capacity of the rubber packing 36 is enhanced.

With the subsurface safety valve spool piece 25 of FIG. 3 installed in the manner described and shown in FIGS. 2 and 4, product may be introduced and removed from the salt dome storage facility in the same manner as that described for a storage well without the spool piece 25 as the valves 38 remain in an open position unless actuated. In the event of an emergency situation, the valves may be closed, sealing the annual space completely, and shutting down product flow.

As an example, for product removal, inlet 12 of the casing cross flange 17 and outlet 46 of the tubing cross flange 19 are closed. Brine water is pumped into the tubing cross flange 19 through inlet 10 into tubing 18 and down in to lower zone 28 of the storage cavity 27. The pressure exerted by this flow forces the product from the upper zone 28 of the storage cavity 27 into the borehole 24, through the casing 22 via the annulus 20. The product is diverted around the seal created by the tubing hanger 14A through the diverter piping 32 of the spool piece 25 and into the casing flange 17 to the outlet 48. The safety valve 38 remains open through out normal operation of the system.

The safety valve 38 of the spool piece 25 will be closed by actuator 40 by engagement with ESD 50 only in the event of an emergency. The ESD 50 may be designed to respond to such external factors as differential pressure or heat or may be operated manually to effectuate the closing of the valve 38 should an emergency situation occur at the well site.

FIG. 4 shows an enlarged view of the subsurface safety shut down spool piece 25 installed to a wellhead 15. There is shown a tubing hanger 14A which is used to seal annulus 20 and to support the string of tubing 18. The tubing 18 penetrates the hanger 14A and is fitted to the hanger 14A by threads, friction or other means. Movement of the string tubing 18 is restricted by the tubing hanger 14A which has substantially the same outside diameter as that of the internal diameter of the casing spool piece 25. This also serves to seal the annulus. Upward vertical movement of the tubing hanger 14A is resisted by the buoyant weight of the string of tubing 18 and by lock down pins 42. The hanger 14A is secured to the casing spool piece 25 by friction and upset wedges 43. Expansion rings may also be used. O-rings 44 are utilized around the hanger 14A as an additional leak sealing means.

It is thought that the subsurface safety shut down valve and method of the present invention and many of its attendant advantages will be understood from the foregoing description and it will be apparent that various changes may be make in the form, construction and arrangement of the parts thereof without departing from the spirit and scope of the invention or sacrificing all of its material advantages, the form described herein being merely a preferred or exemplary embodiment of the invention.

I claim:

1. A subsurface shut down valve and wellhead system for salt dome cavern storage wells used for storing liquid or gaseous products comprising:

a) a well borehole starting from a predetermined point below the ground surface to a predetermined depth within said salt dome cavern storage area;

b) tubular casing lining said well borehole longitudinally from its starting point below the surface down to a predetermined depth along the borehole;

c) a tubular casing spool piece having an upper spool piece flange opening and a lower spool piece flange opening, said spool piece mounted longitudinally to said tubular casing at said lower spool piece flange opening at a point below ground level;

d) a wellhead casing mounted longitudinally to said upper flange of said spool piece, said wellhead casing having an upper cross flange section mounted longitudinally to a lower cross flange section, said upper and lower wellhead cross flange sections each having an inlet port and an outlet port, each port being substantially perpendicular to the centerline of said wellhead casing;

e) means for opening and closing said inlet and outlet ports of said wellhead casing;

f) means for injecting selected liquids or gases into said inlet ports of said wellhead casing;

g) a longitudinal tubing string within said wellhead, said spool piece and said cased well borehole, said tubing string beginning at a point just below said inlet and outlet ports of said upper wellhead cross flange and ending at a predetermined point within said salt dome cavern so as to form an annular space between said tubing string and said cased wellbore, said casing spool piece and said wellhead casing;

h) a tubing hanger mounted within said casing spool piece between said upper and lower flange openings of said spool piece for suspending said tubing string longitudinally within said well borehole and for sealing said annular space between said tubing string and said casing spool piece;

i) a plurality of piping segments in communication with said annular space between said tubing string and said casing spool piece at points above and below said tubing hanger;

j) a valve mounted to each of said piping segments; and k) actuator means for opening and closing said valves from a remote location above ground surface.

2. The subsurface shutdown valve and wellhead system as recited in claim 1 wherein said means for opening and closings said valves includes automatic means.

3. The subsurface shutdown valve and wellhead system as recited in claim 2, further comprising means for sealing said annular space between said wellhead casing and said tubing string at the interface of said upper and lower cross flange segments of said wellhead casing.

4. The subsurface shutdown valve and wellhead system as recited in claim 3 wherein said means for sealing said annular space is rubber packing.

5. The subsurface shutdown valve and wellhead system as recited in claim 4 wherein said tubing hanger is comprised of a downwardly beveled metal coupling mounted to the outside circumference of said tubing string, said coupling having a maximum diameter substantially the same as the inside diameter of said spool piece and being seated against the inside circumference of said spool piece casing by upwardly beveled circumferential wedges between said coupling and said spool piece and secured by mounting pins perpendicular to said tubing string.

6. The subsurface shutdown valve and wellhead system as recited in claim 5 further comprising rubber O rings between said upwardly beveled wedges and said coupling.

7. The subsurface shutdown valve and wellhead system as recited in claim 1 wherein the cross-sectional area of said piping segments is substantially the same as the cross-sectional area of said outlet of said lower flange segment of said wellhead casing.

8. The subsurface shutdown valve and wellhead system as recited in claim 7 wherein said spool piece is contained within a manhole below ground level.

9. A subsurface shutdown safety valve spool piece for underground salt dome cavern storage wells having a cased wellhead at ground level with openings for product input and removal, a wellbore having tubular casing and a tubing string extending to said cavern within said wellbore forming an annular space between said wellbore and said tubing string comprising:

a) a tubular casing spool piece of substantially the same diameter as the wellbore casing for mounting between said wellhead casing and said cased borehole below ground level;

b) means for suspending said tubing string within said casing spool piece;

c) means for sealing the annular space between said casing spool piece and said tubing string;

d) piping communicating with said annular space above and below said annular space sealing means;

e) a valve for opening and closing said piping.

10. The valve spool piece as recited in claim 9 further comprising means for remotely closing and opening said valves from above the ground surface.

11. The valve as recited in claim 10 wherein said means for remotely closing and opening said valve includes pneumatic means.

12. The valve spool piece as recited in claim 10 wherein said means for remotely opening and closing said valve includes electronic means.

13. The valve spool piece as recited in claim 10 wherein said means for remotely opening and closing said valve includes automatic means.

14. The valve spool piece as recited in claim 9 wherein the cross-sectional area of said piping is substantially the same as the cross-sectional area of said annular space between said tubing string and said spool piece.

* * * * *